US011353294B2

(12) United States Patent
Hall

(10) Patent No.: US 11,353,294 B2
(45) Date of Patent: Jun. 7, 2022

(54) MODULAR ARMOR SYSTEM

(71) Applicant: CHAMELEON ARMOR CO, LLC, Topeka, KS (US)

(72) Inventor: Brandin Hall, Topeka, KS (US)

(73) Assignee: CHAMELEON ARMOR, LLC, Topeka, KS (US)

( * ) Notice: Subject to any disclaimer, the term of this patent is extended or adjusted under 35 U.S.C. 154(b) by 0 days.

(21) Appl. No.: 16/785,346

(22) Filed: Feb. 7, 2020

(65) Prior Publication Data

US 2020/0256646 A1 Aug. 13, 2020

Related U.S. Application Data

(60) Provisional application No. 62/802,374, filed on Feb. 7, 2019.

(51) Int. Cl.
*F41H 5/013* (2006.01)
*F41H 5/04* (2006.01)

(52) U.S. Cl.
CPC ..... *F41H 5/013* (2013.01); *F41H 5/04* (2013.01)

(58) Field of Classification Search
CPC ..... F41H 5/04; F41H 5/013
USPC ..... 89/36.05
See application file for complete search history.

(56) References Cited

U.S. PATENT DOCUMENTS 3,577,836 A * 5/1971 Tamura ..... A41D 31/245 2/2.5
4,198,454 A * 4/1980 Norton ..... B32B 3/12 428/117
4,404,889 A * 9/1983 Miguel ..... F41H 5/0442 89/36.02
4,822,657 A * 4/1989 Simpson ..... B32B 7/02 428/69
5,918,309 A * 7/1999 Bachner, Jr. ..... A41D 31/245 2/2.5
6,082,240 A * 7/2000 Middione ..... F41H 5/013 296/187.07

(Continued)

FOREIGN PATENT DOCUMENTS

EP 1804019 A1 * 7/2007 ..... F41H 5/0478

OTHER PUBLICATIONS https://www.marinecorpstimes.com/news/your-marine-corps/2018/10/31/the-marine-corps-is-buying-new-body-armor-as-it-works-to-upgrade-the-fit-feel-and-protection-of-vital-gear/; last accessed on Apr. 23, 2020.

(Continued)

*Primary Examiner* — John Cooper
(74) *Attorney, Agent, or Firm* — Kutak Rock LLP; Brian L. Main

(57) ABSTRACT

A modular armor system is provided. The modular armor system includes an encasement for holding one or more interior plate, thereby providing a variety of protection options. The encasement is moveable from an open configuration to a closed configuration. In the open configuration, a user can inspect plate conditions and configurations prior to using such system, thereby allowing the user to replace damaged plates and/or to change plate configurations. The system is configured to allow bullets to penetrate the encasement, thereby reducing impact to users while reducing shrapnel associated with bullet spalling. By including one or more penetrable, buffer, retaining, or other plate within the encasement, users can further decrease impact and/or other risks associated with the same.

20 Claims, 11 Drawing Sheets

(56) References Cited

U.S. PATENT DOCUMENTS 6,253,655 B1 * 7/2001 Lyons ..... F41H 5/0428 89/36.02
7,520,205 B1 * 4/2009 Colliflower ..... F41H 5/0421 109/80
7,866,248 B2 * 1/2011 Moore, III ..... F41H 5/0421 89/36.02
8,151,685 B2 * 4/2012 Joynt ..... F41H 5/023 89/36.02
8,297,177 B2 * 10/2012 Schulte ..... B32B 15/20 89/912
8,336,439 B2 * 12/2012 St. Claire ..... F41H 5/0457 89/36.02
8,695,476 B2 * 4/2014 Kucherov ..... F41H 5/0428 89/36.02
8,863,634 B1 * 10/2014 Lou ..... F41H 5/0471 89/36.02
8,869,316 B2 10/2014 Lewis
9,335,129 B1 * 5/2016 Perciballi ..... F41H 5/0457
9,383,175 B2 * 7/2016 Walter ..... F41H 5/0471
9,534,872 B2 * 1/2017 Bain ..... F41H 5/0428
9,726,459 B2 * 8/2017 Waldrop ..... F41H 5/0428
9,752,854 B1 * 9/2017 Rittenhouse, Jr. ... A41D 31/245
9,879,946 B2 * 1/2018 Holtz ..... F41H 5/0428
10,563,960 B2 * 2/2020 Carton ..... F41H 5/0457
2010/0212486 A1 8/2010 Kurtz et al.
2011/0067561 A1 * 3/2011 Joynt ..... F41H 5/023 89/36.02
2012/0180178 A1 * 7/2012 Gallo ..... F41H 1/02 2/2.5
2015/0377595 A1 * 12/2015 Scarinci ..... F41H 5/0407 89/36.02
2017/0276457 A1 * 9/2017 Chapman ..... F41H 1/02
2018/0128577 A1 * 5/2018 Beck ..... F41H 5/013
2019/0383583 A1 * 12/2019 Carkner ..... B06B 1/064

OTHER PUBLICATIONS https://amp.businessinsider.com/us-army-new-helmets-body-armor-will-make-soldiers-harder-to-kill-2019-3; last accessed on Apr. 23, 2020.

"International Search Report from international application No. PCT/US2020/017322 filed Feb. 7, 2020", dated Nov. 17, 2020, 3 pgs.

"Written Opinion of the International Searching Authority from international application No. PCT/US2020/017322, filed Feb. 7, 2020", dated Nov. 17, 2020, 10 pgs.

* cited by examiner

MODULAR ARMOR SYSTEM

CROSS-REFERENCE TO RELATED APPLICATIONS

This application claims priority pursuant to 35 U.S.C. 119(e) to U.S. Provisional Patent Application Ser. No. 62/802,374, filed Feb. 7, 2019, the entire disclosure of which is incorporated herein by reference.

FIELD OF THE INVENTION

The present invention relates generally to protection equipment. More specifically, the present invention is concerned with a modular armor system.

BACKGROUND

Military personnel and first responders are often placed in hazardous situations. In many such situations, availability of proper protection equipment, such as body armor, vehicle plating, and the like (each being "armor"), can be the difference between life and death. Unfortunately, proper armor for one situation may not be proper in another situation. Furthermore, such armor can be expensive, often frustrating, or even thwarting, efforts to provide adequate armor. Consequently, it would be beneficial to have a versatile armor system that is capable of providing proper protection for a variety of situations. It would further be beneficial if the armor system was cost effective.

Existing armor is designed based on known and anticipated risks. Unfortunately, as armor is improved, ammunition is also improved, often nullifying such improvements to the armor or otherwise exploiting potential weaknesses in armor. In such events, the effectiveness of such armor can be drastically reduced, often requiring replacement of such armor. Consequently, it would be beneficial to have an armor system that is capable of being incrementally upgraded if and as required to address current risks that were previously unanticipated or otherwise not adequately addressed by the armor system. It would further be beneficial if such upgrades did not require replacement of such armor, such as by retrofitting the armor system.

While most armor is designed to withstand at least one impact, some armor, such as ceramic or other brittle armor, has a tendency to shatter, thereby reducing or eliminating the effectiveness of the armor to withstand multiple impacts. In some instances, a first impact can be associated with a first bullet impact or even simply dropping the armor on a hard surface. In some instances, a user of the armor may not even know that effectiveness of the armor has been compromised until after the armor fails, such as by failing to stop a bullet or other projectile during a second or other subsequent impact. Consequently, it would be beneficial to have an armor system that is configured to mitigate damage during a first impact and/or that is configured to otherwise increase effectiveness of the armor to withstand multiple impacts. It would further be beneficial if the armor system included a feature for allowing a user to quickly and easily determine whether the effectiveness of the armor system has been compromised, such as from one or more impact.

Even if proper armor is available, it may be impractical for one or more situation. For instance, armor can be heavy, often causing fatigue or frustration to a user, especially over long periods of time. Weight can be especially troublesome in water. Consequently, it would be beneficial to have an armor system that is lightweight and comfortable. It would further be beneficial if the armor system included, or could be configured to include, buoyancy properties.

Even if armor is worn properly, impacts from high-velocity projectiles can cause severe harm to a wearer. Furthermore, shrapnel from the projectile can harm or even kill the wearer or those in the vicinity of the wearer. Consequently, it would be beneficial to have an armor system that reduces impacts to the wearer. It would further be beneficial if the armor system reduced or eliminated shrapnel associated with such impact.

SUMMARY

The present invention comprises a modular armor system that is capable of providing proper protection for a variety of situations. The system includes an outer encasement that is configured to hold one or more plate, the combination of which provides the desired protection. The system is configured to reduce impact to users while also reducing shrapnel and other deflected items associated with traditional armor systems. Each plate can be removed from the outer encasement, thereby facilitating inspection of and, if necessary, replacement of the same. One or more plate can be removed from, added to, and/or repositioned within the outer encasement, thereby reconfiguring the armor system.

The modular armor system includes an outer encasement that is configured to hold one or more plate, each being a component of the system. In some embodiments, one or more component is replaceable and/or interchangeable with one or more other component, thereby facilitating selective refurbishment and/or reconfiguration of the same. In some embodiments, one or more reconfiguration of the system is associated with an upgrade to the system, such as an upgrade to address new or different risks, such as risks that were previously unanticipated. In some embodiments, at least some components are formed from low-cost materials.

The present system provides a cost-effective solution to existing systems while also providing better protection, pound-for-pound, than is currently available. Furthermore, the modular functionality of the present system allows for incremental upgrades as the need arises. The system comprises a variety of layers, each layer serving one or more function (i.e., reducing impact and eliminating shrapnel), thereby providing a comprehensive protection system.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION

Figure 1:
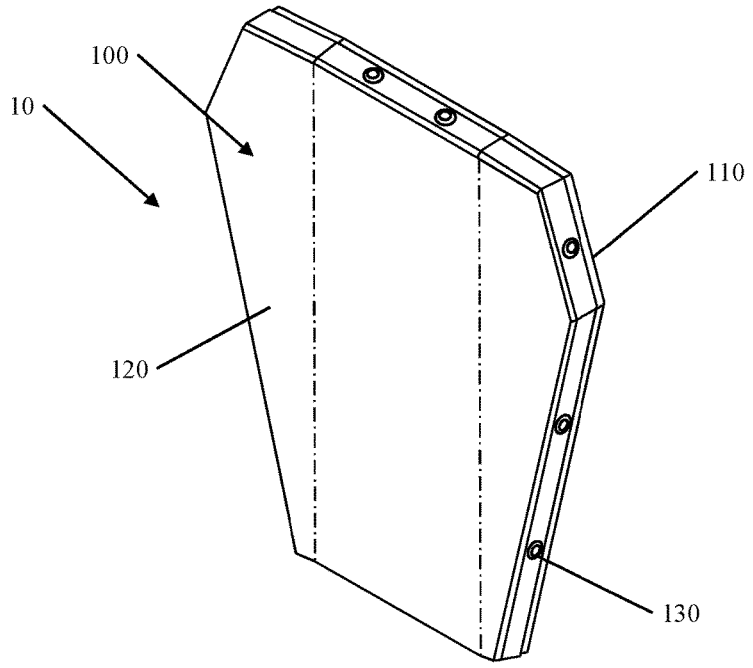
FIG. 1 is rear perspective view of a plate assembly of the present invention.
Figure 2:
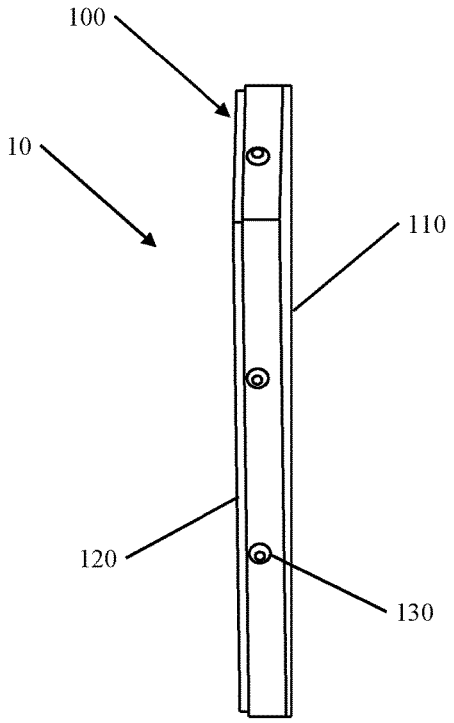
FIG. 2 is a side view of the plate assembly of FIG. 1.
Figure 3:
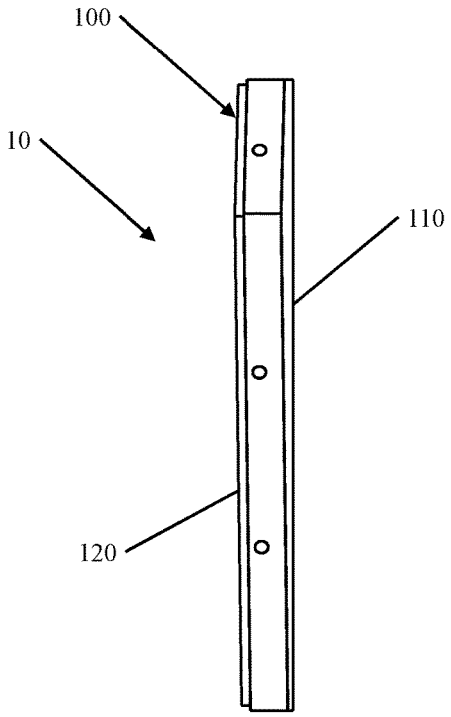
FIG. 3 is a side view of the plate assembly of FIG. 1, with fasteners being removed.

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIG. 1 and FIGS. 8-15, the present invention comprises a plate assembly 10 having an outer encasement 100 for holding one or more plate 210, 220, 230. In some embodiments, the outer encasement 100 includes a front shell 110 that is configured to engage with a rear shell 120, thereby forming an interior volume for holding the one or more plate. In some embodiments, the system includes one or more means of retaining the plate assembly in close proximity to one or more vehicle, building, person, or the like, thereby providing and/or increasing protection to the same. In some embodiments, the plate is configured to be selectively added to or replaced from body armor, such as vests or the like.

In some embodiments, the outer encasement 100 is moveable between an open configuration and a closed configuration. In the open configuration, a user can inspect plates and plate configurations and/or replace the same, such as to replace damaged plates and/or to reconfigure the system. In the closed configuration, the plates are securely positioned within an interior area of the system. In some embodiments, the plate assembly 10 is moveable to a secured configuration, such as by utilizing a plurality of fasteners 130 or the like to couple the front shell 110 with the rear shell 120, thereby preventing or otherwise inhibiting the system from moving away from the closed configuration. It will be appreciated that some embodiments include one or more fastener system now known or later developed, such as quarter-turn fasteners having a first portion engaged with a first flange and a second portion engaged with a second flange, the first portion being configured to selectively engage with and disengage from the second portion. In this way, the first flange is quickly and easily coupled to or decoupled from the second flange, thereby quickly and easily moving the plate assembly between the secured configuration and an unsecured configuration.

Figure 4:
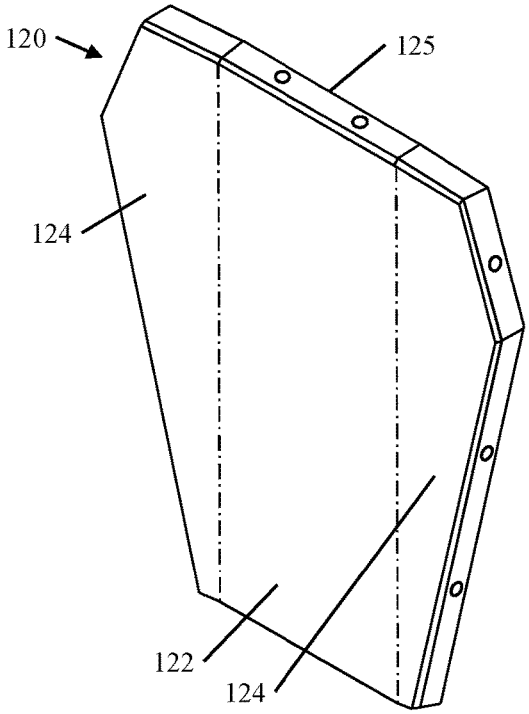
FIG. 4 is a rear perspective view of a rear shell of an outer encasement of the plate assembly of FIG. 1.
Figure 5:
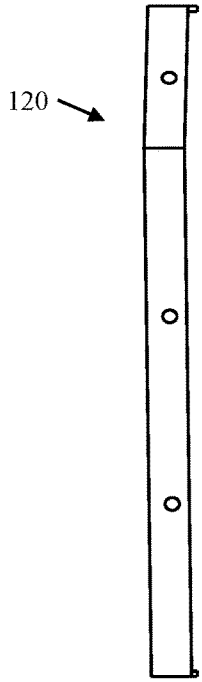
FIG. 5 is a side view of the rear shell of FIG. 4.
Figure 6:
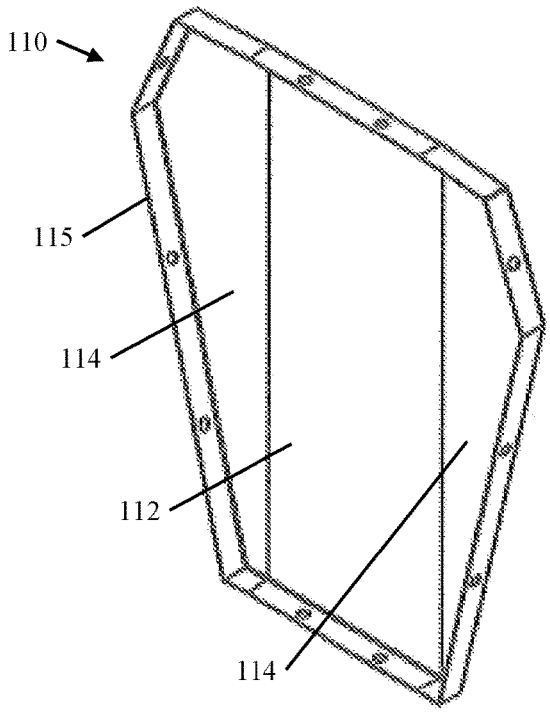
FIG. 6 is a rear perspective view of a front shell of the outer encasement of the plate assembly of FIG. 1.
Figure 7:
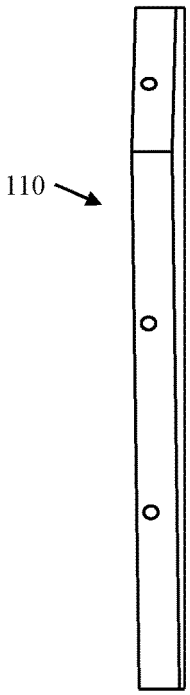
FIG. 7 is a side view of the front shell of FIG. 6.
Figure 8:
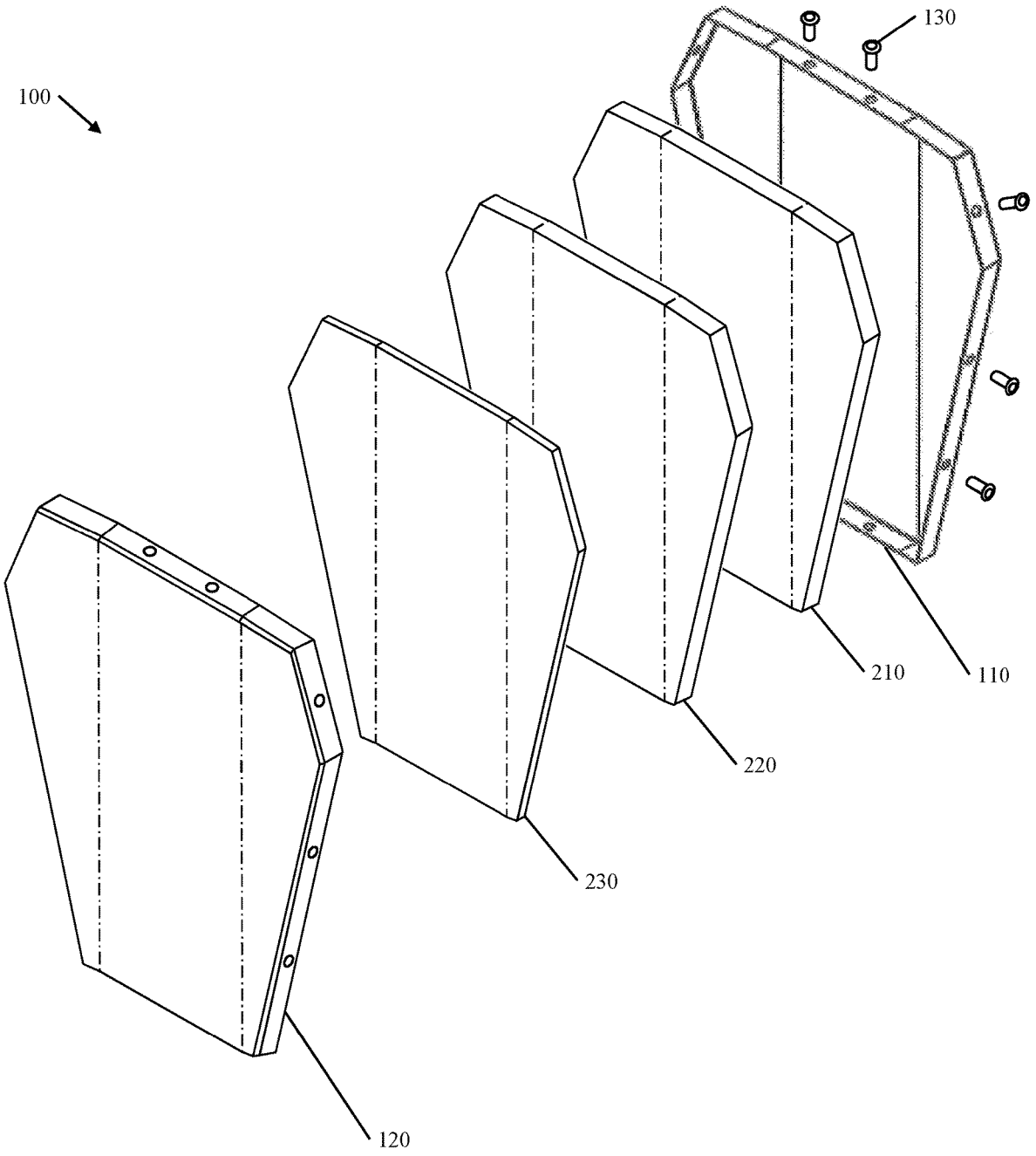
FIGS. 8 through 15 show exploded views of various embodiments of plate assemblies of the present invention.
Figure 9:
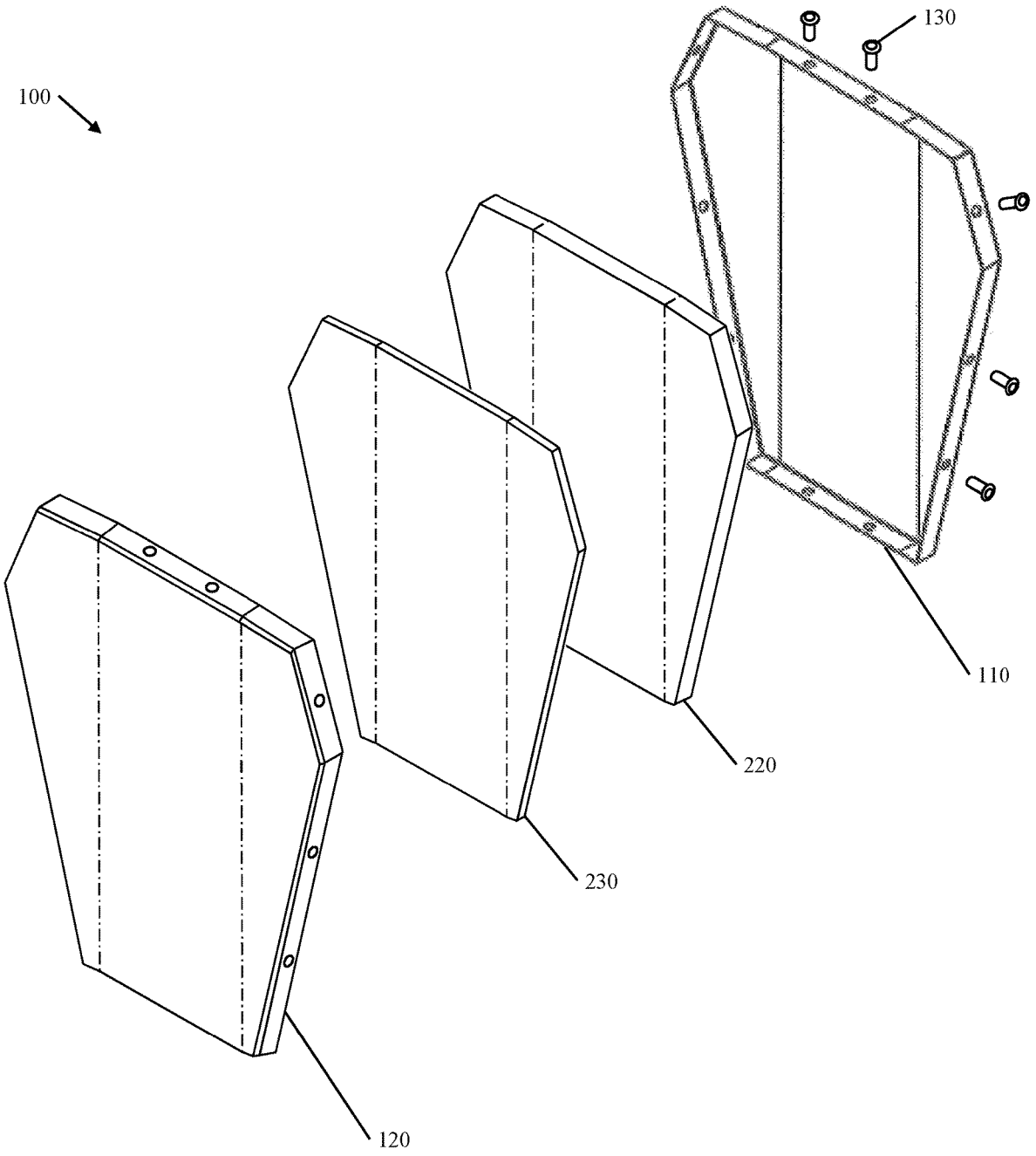
Figure 10:
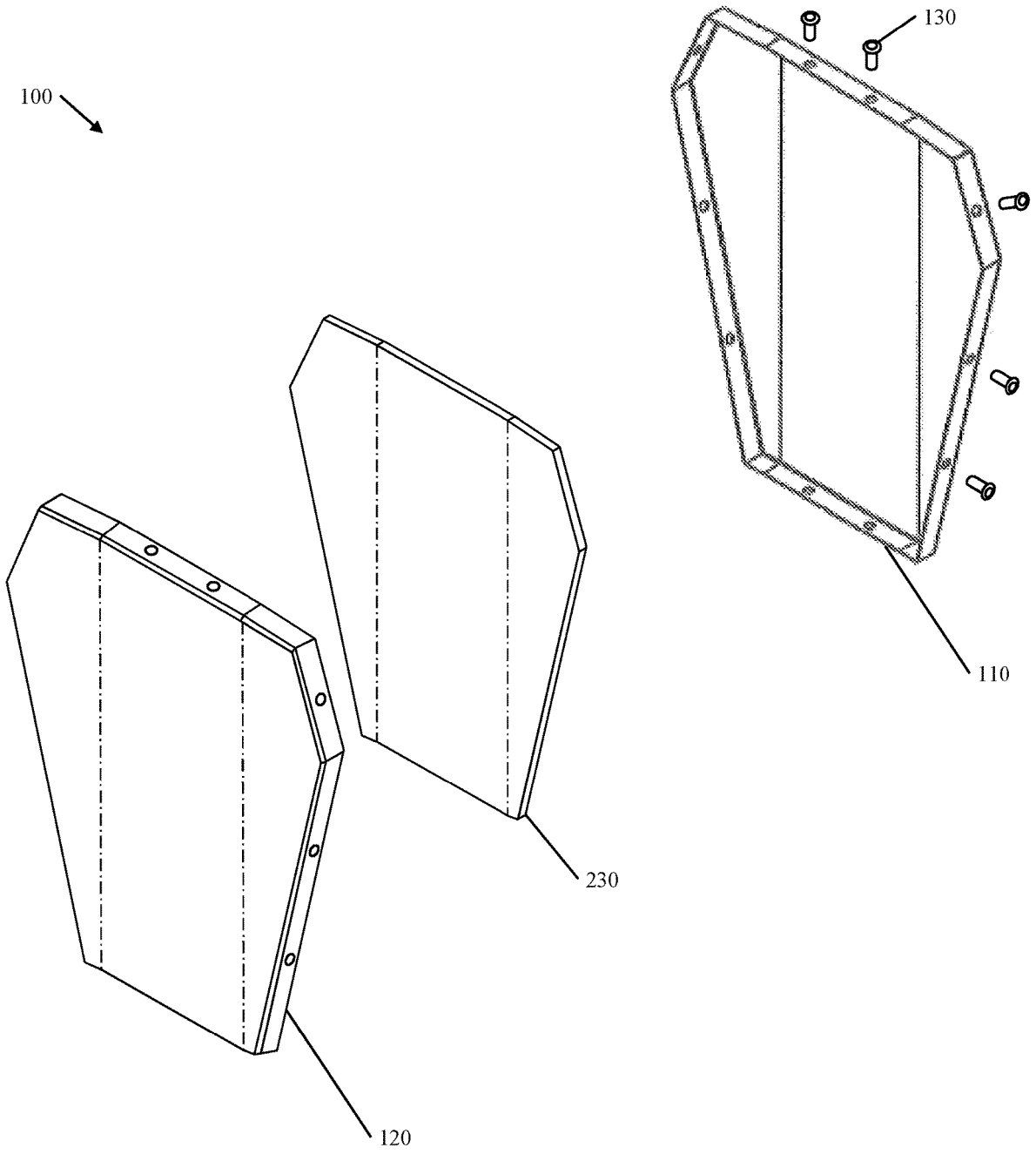
Figure 11:
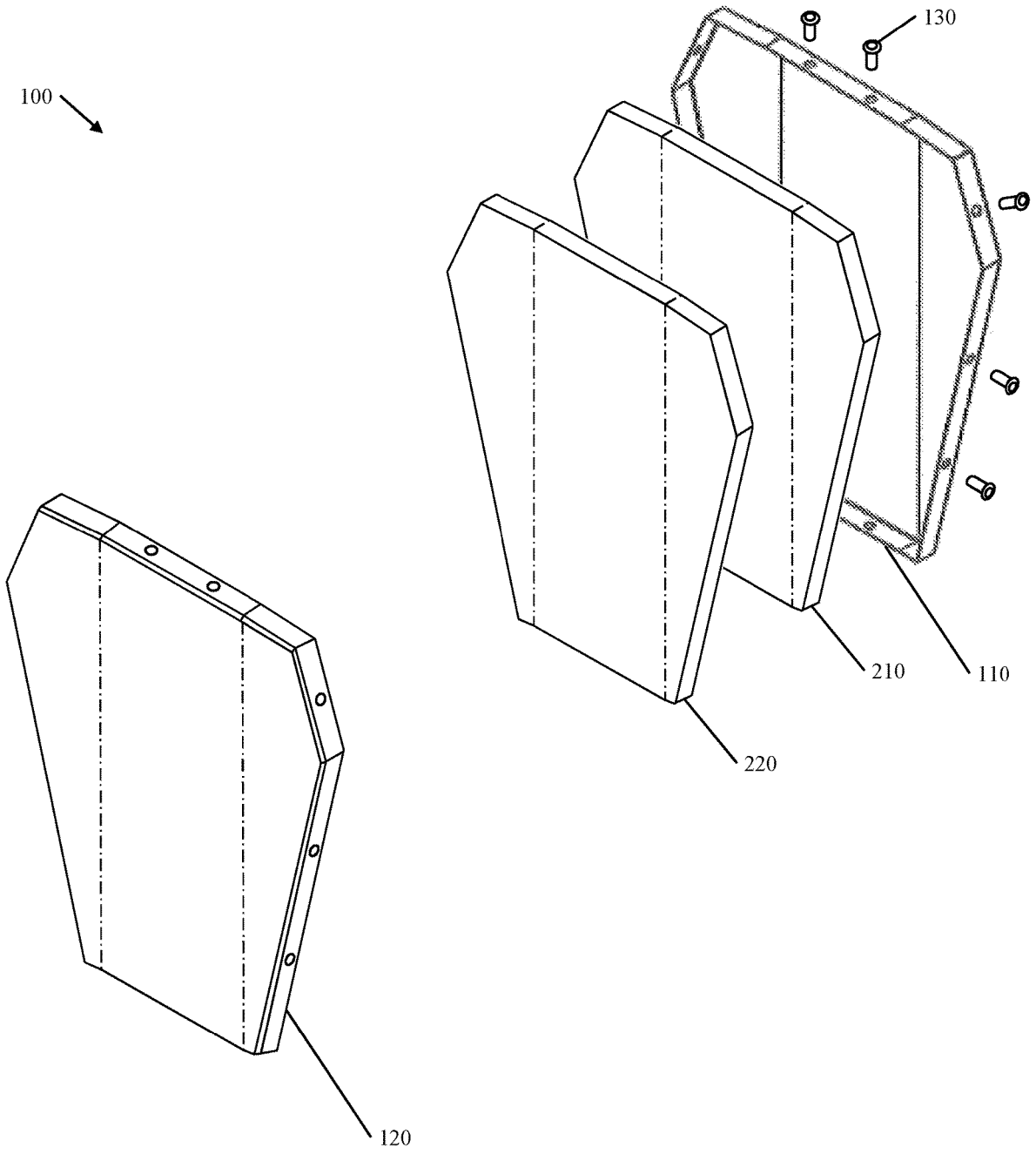
Figure 12:
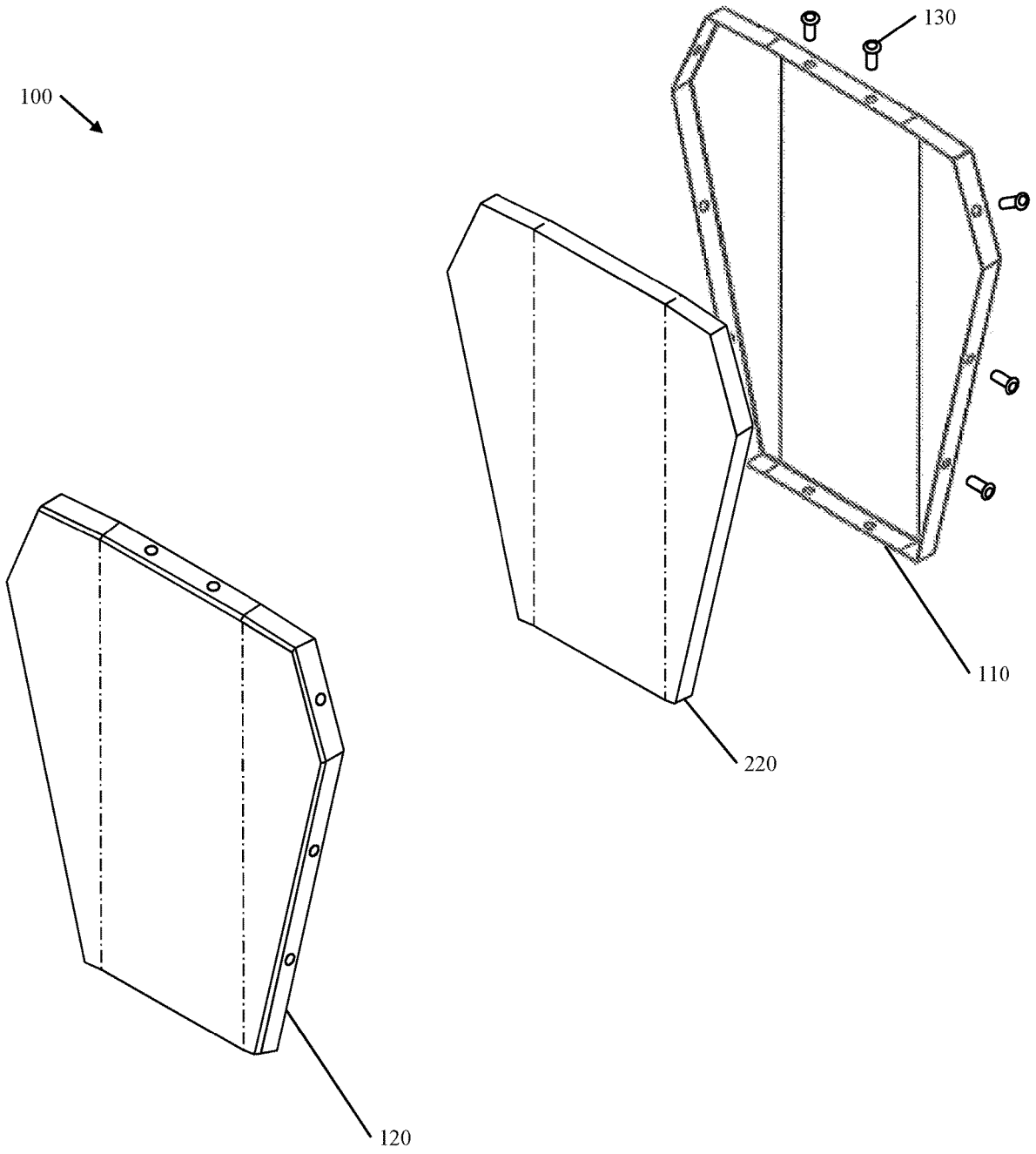
Figure 13:
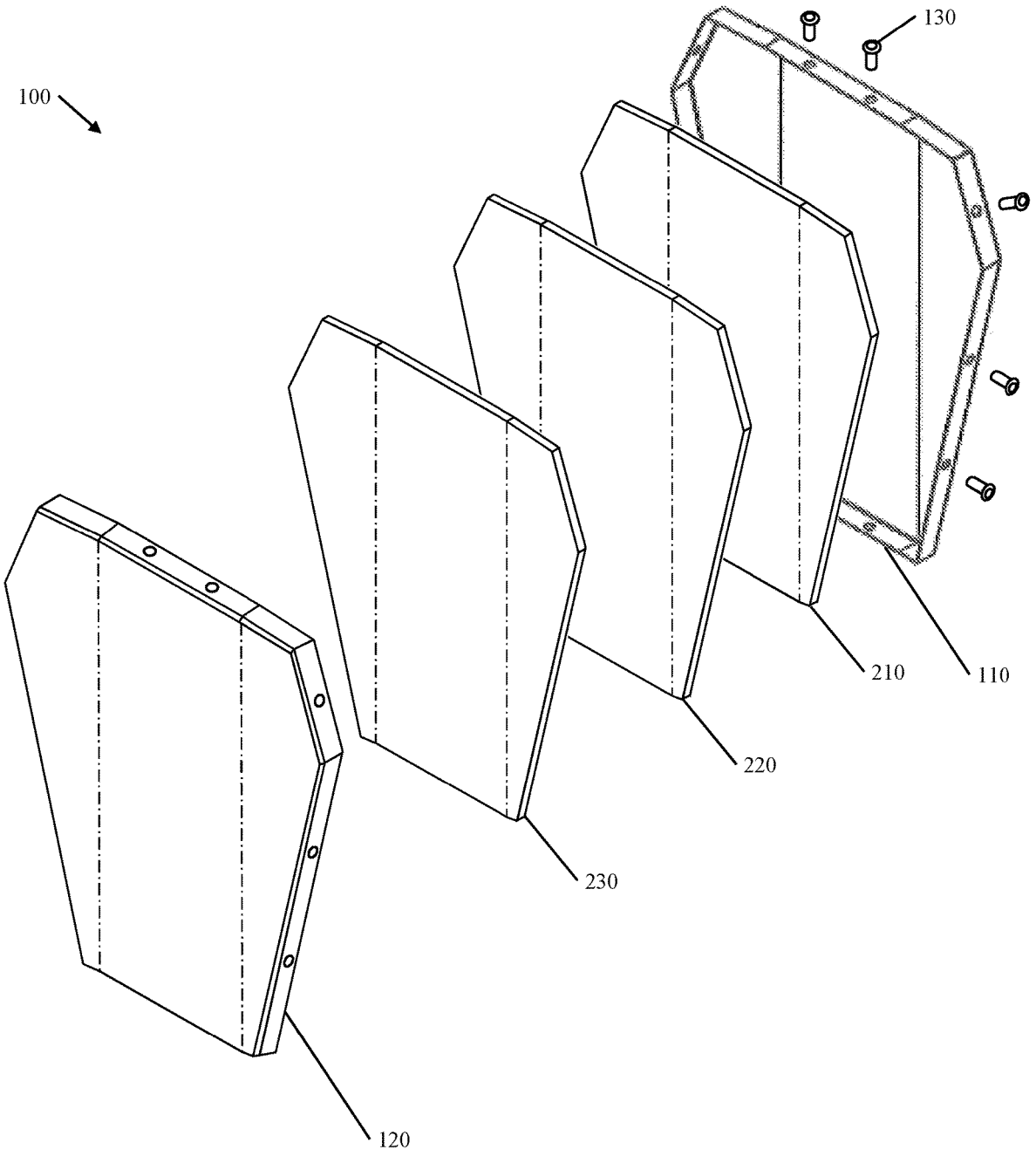
Figure 14:
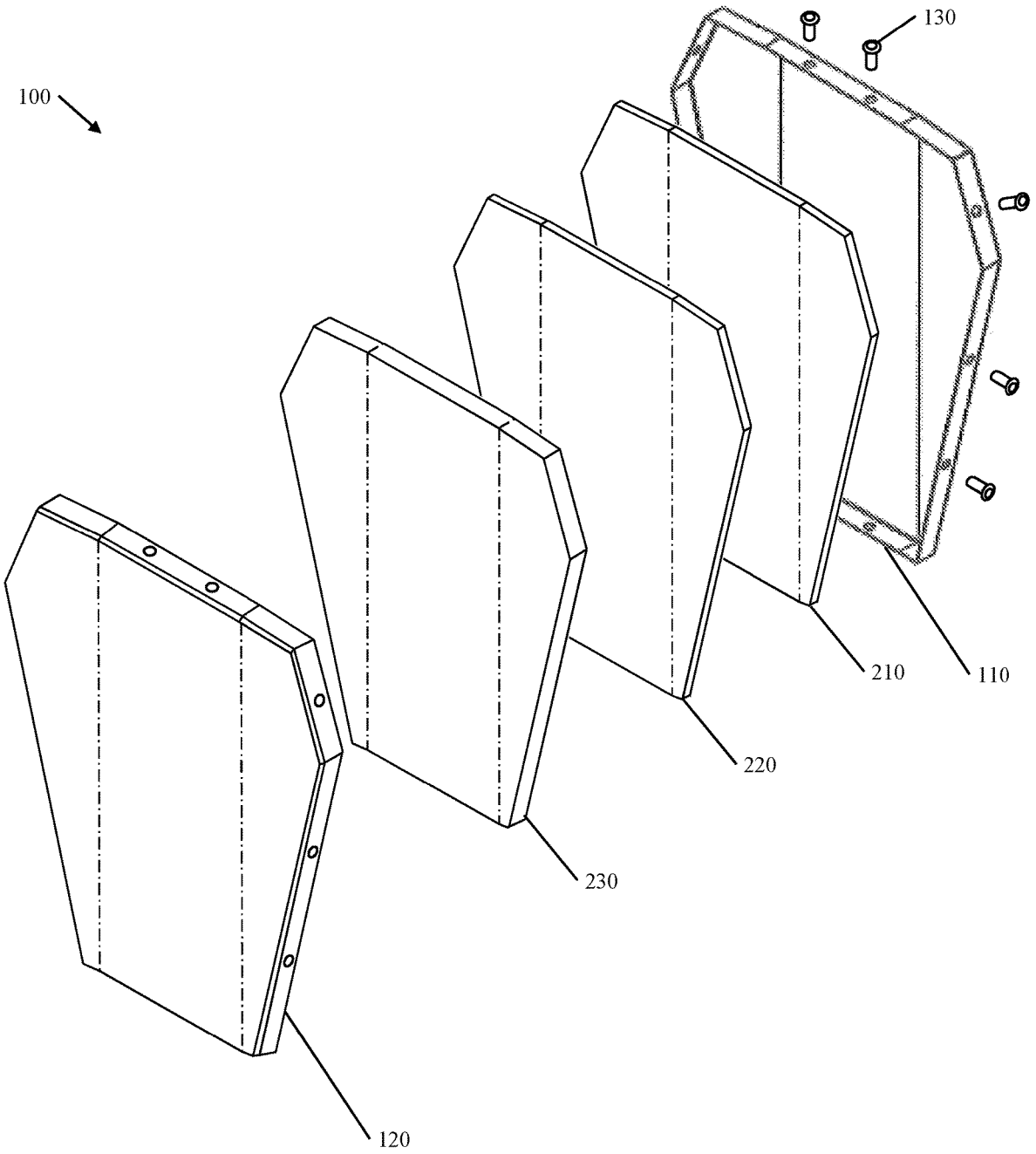
Figure 15:
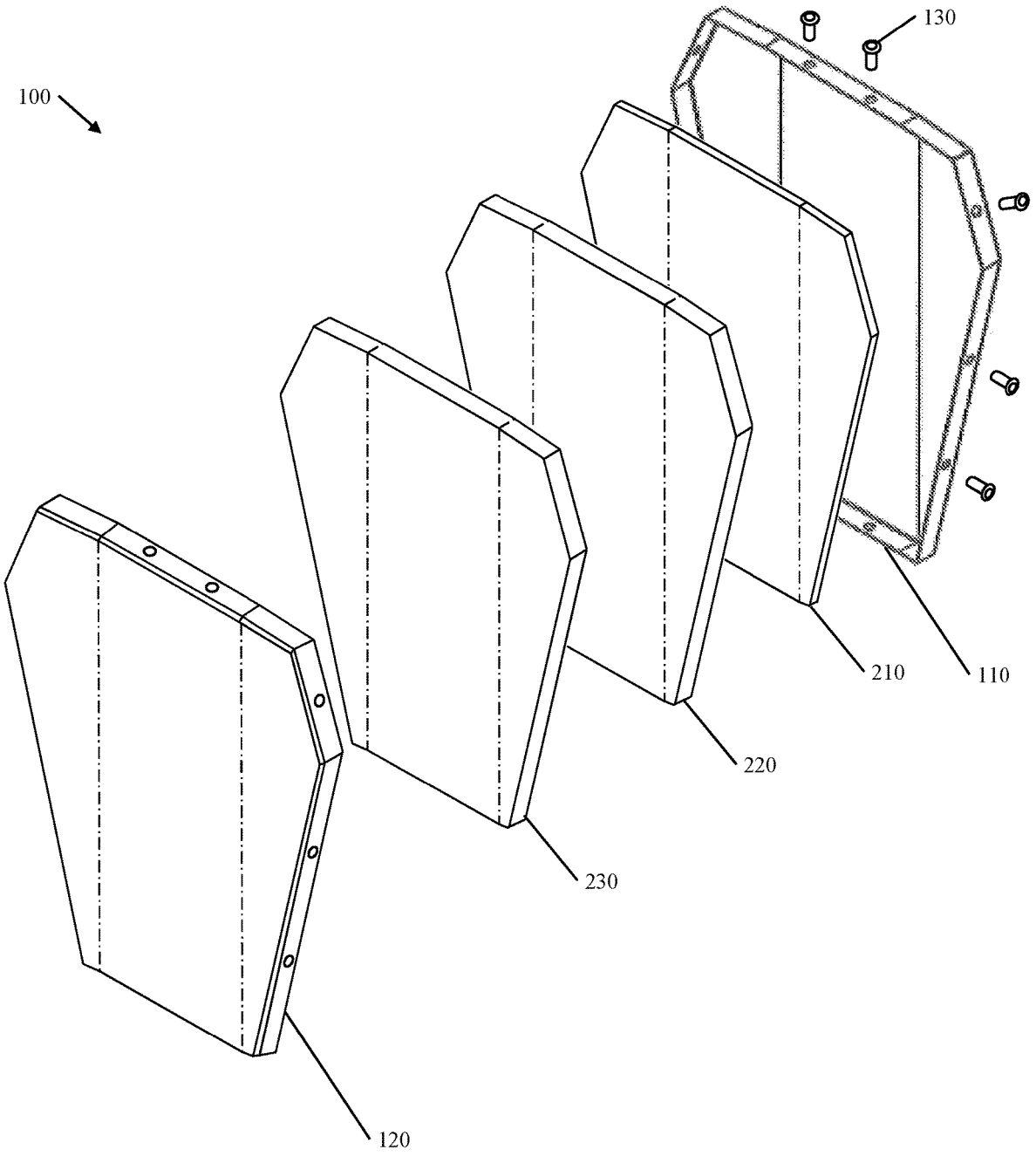
Figure 16:
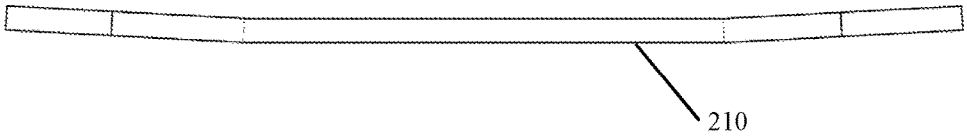
FIG. 16 is an end view of an embodiment of a plate of the present invention.
Figure 17:
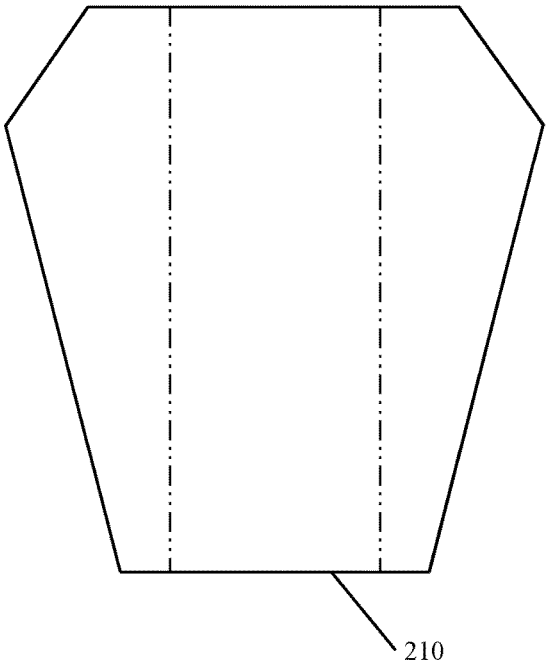
FIG. 17 is a front view of the plate of FIG. 16.

Referring to FIG. 8, some embodiments of the present invention include a front shell 110, a rear shell 120, a first interior plate 210, a second interior plate 220, and a third interior plate 230. Referring to FIG. 6, some embodiments of the front shell 110 include a front plate having a front portion 112 positioned between opposed side portions 114. In some embodiments, the front shell 110 further includes a front flange 115 extending rearward towards the rear shell 120. Referring to FIG. 4, some embodiments of the rear shell 120 include a rear plate having a rear portion 122 positioned between opposed side portions 124. In some embodiments, the rear shell 120 further includes a rear flange 125 extending forward towards the front shell 110. In some embodiments, the front 110 and rear 120 shells each include respective engagement features for securing the same together. In some embodiments, each of the front 115 and rear 125 flanges define respective engagement holes, each being configured to receive a respective fastener 130 for securing the shells together.

In some embodiments, the front shell 110 is formed from a stainless-steel material. In some embodiments, the front shell is configured to be penetrated such that impact, shrapnel, and/or other risks are reduced. In some embodiments, the rear shell 120 is formed from a stainless-steel material. In some embodiments, the rear shell 120 is formed from the same material as the front shell 110.

In some embodiments, the first interior plate 210 is formed, at least in part, from a penetrable material, such as an ultra-high molecular polyethylene material ("UHMP"). In some embodiments, the second interior plate 220 is formed, at least in part, from a dampening material, such as a synthetic viscoelastic urethane polymer (i.e. SORBOTHANE) or the like. In some embodiments, the third interior plate 230 is formed, at least in part, from a hard material, such as a boron silicon carbide material.

The modular armor system includes a plurality of components, many of which form a layer of the system. In this way, the system includes a plurality of layers, at least one of which is a stopping layer (such as a stopping plate) that is designed to stop a bullet or other projectile, such as shrapnel or the like (each a "bullet"). In some embodiments, one or more layer of the system is a penetrable layer (such as a penetrable plate) that is configured to be penetrated by a bullet as the bullet travels towards the stopping layer. In some embodiments, the system includes a plurality of penetrable layers, at least one such penetrable layer being a front portion 112 of the front shell 110. In some embodiments, the classification of each component of a system as providing a stopping layer or a penetrable layer is dependent upon the anticipated risks associated with use of such system.

In some embodiments, the system is configured to mitigate damage during a first impact, such as by reducing impact to one or more stopping layer of the system. In some embodiments, the system includes one or more buffer layer (such as a buffer plate) for absorbing and/or distributing impact forces. In this way, damage to the stopping layer is prevented and/or otherwise reduced. In some embodiments, the buffer layer is positioned in front of a stopping layer. In some embodiments, the buffer layer is positioned behind a stopping layer and/or extends at least partially around the stopping layer. In some embodiments, the buffer layer and/or another layer is configured to prevent or otherwise inhibit fracturing of the stopping plate and/or to reduce risks associated with such fracturing. In some embodiments, one or more buffer layer is secured to one or more other layer, such as a stopping layer, a penetrable layer, or the like. In some embodiments, the buffer layer is a penetrable layer or the like.

In some embodiments, the system includes a maintenance layer (such as a maintenance plate) for mitigating risks associated with a first impact. In some embodiments, the maintenance layer is configured to retain fractured pieces of a stopping layer (or another layer) in their respective places, thereby maintaining a substantially continuous protection layer (or other layer) and/or otherwise increasing effectiveness of the armor to withstand multiple impacts. In some embodiments, the armor system includes one or more access hole for viewing internal plates and/or includes one or more other feature for allowing a user to quickly and easily determine whether the effectiveness of the armor system has been compromised, such as from one or more impact. In some embodiments, one or more maintenance layer is secured to one or more other layer, such as a stopping layer, a penetrable layer, a buffer layer, or the like. In some embodiments, the maintenance layer is a penetrable layer, a buffer layer, or the like.

In some embodiments, the system is designed to reduce overall weight while maintaining or increasing stopping power associated with existing systems. In some embodiments, the system includes one or more buoyant layer or plate and/or otherwise includes one or more feature for providing buoyancy properties, such as by including and/or integrating with a buoyancy system. In some embodiments, one or more buoyant plate is secured to one or more other plate, such as a stopping plate, a penetrable plate, a buffer plate, a maintenance plate, or the like. In some embodiments, the buoyant plate is a penetrable plate, a buffer plate, a maintenance plate, or the like.

In some embodiments, the system is configured to slow the bullet prior to impact with a stopping layer, thereby reducing impacts to the wearer. In some embodiments, the system includes one or more other feature for reducing impact to a user, such as by including one or more buffer layer between the stopping layer and the user. In some embodiments, the system includes one or more feature or system (and/or integrates with the same) for measuring and/or predicting impact to a user and/or for measuring and/or predicting harm to the user, such as internal bleeding or the like. In some embodiments, the system is configured to provide a warning to the user, a team member, a monitoring entity, a bystander, or the like, thereby facilitating identification of potential life-threatening situations and/or facilitating dispatch of necessary care for the same. In some embodiments, the system includes a monitor for monitoring heart rate and/or other vitals of a user. In some embodiments, the system includes and/or integrates with a defibrillator or the like.

In some embodiments, the system includes one or more retention layer (such as a retention plate). In some embodiments, a retention layer is configured to retain a bullet and/or pieces of a bullet in close proximity to a stopping layer, thereby preventing the bullet and/or the pieces of the bullet from ricocheting or otherwise creating a risk to the user and/or people and property in close proximity to the user. In some embodiments, one or more retention layer is secured to one or more other layer, such as a stopping layer, a penetrable layer, a buffer layer, a maintenance layer, or the like. In some embodiments, the retention layer is a penetrable layer, a buffer layer, a maintenance layer, or the like.

In some embodiments, the system includes one or more ripping layer. In some embodiments, the ripping layer is configured to cause a first portion of a bullet to be ripped from a second portion of the bullet. In some embodiments, the first portion of the bullet is a jacket or casing of the bullet and the second portion of the bullet is a core of the bullet (each of the first and second portions of the bullet being a "bullet"). In some embodiments, the stripping plate is a retention layer for the first portion of the bullet and a penetrable layer, buffer layer, and/or retention layer for the second portion of the bullet.

In some embodiments, the system includes an outer encasement 100 containing one or more plate 210, 220, 230. In some embodiments, a front shell 110 of the encasement includes a front plate of the system. In some embodiments, the front plate is a stopping plate, a penetrable plate, a buffer plate, a maintenance plate, a retention plate, a ripping plate, or the like for one or more bullet or other threat. In some embodiments, the front plate is a stopping plate for a first bullet, such as a .22 caliber bullet. In some embodiments, the front plate is a penetrable plate for a second bullet, such as a .44 caliber bullet. In some such embodiments, the front plate is a buffer plate, a retention plate, a ripping plate, and/or the like.

In some embodiments, the front plate includes a front portion 112 and opposed side portions 114 angled away from the front portion, thereby more accurately shaping to a form of a user. In some embodiments, the front 112 and/or side 114 portions are configured so as to reduce risks associated with bullets ricocheting off a first user towards a second user positioned adjacent to the first user. In some embodiments, the size and angle of each of the front and side portions are configured to reduce ricochet, such as by increasing the likelihood that a bullet will penetrate and/or be retained by the same. In some embodiments, one or more plate associated with the system of the present invention includes a front portion and respective side portions, similar to the front portion and respective side portions of the front shell 110.

In some embodiments, a rear shell 120 of the encasement includes a rear plate of the system. In some embodiments, the rear plate is a stopping plate, a maintenance plate, a buffer plate, or the like. In some embodiments, the rear plate includes a rear portion 122 and opposed side portions 124 angled away from the rear portion 122, thereby more accurately shaping to a form of a user and/or more accurately mating the shape of the front plate and/or one or more intermediate plate. In some embodiments, the encasement includes one or more flange extending between the front and rear plates, thereby defining an external barrier surrounding edges of one or more intermediate plate. In some embodiments, the encasement includes one or more feature for connecting the front shell to the rear shell, such as a sliding and/or hinging feature or the like. In some embodiments, the front shell defines a front lip 115 and the rear shell defines a rear lip 125, the rear lip being configured to engage with the front shell when the system is in a closed configuration. In some embodiments, the front and rear shell each define one or more engagement feature, such as aligned fastener holes, for enabling securement of the encasement in the closed configuration.

In some embodiments, the present invention includes a method of configuring one or more system for providing one or more protection scheme associated with an anticipated risk. In some embodiments, the method includes moving an encasement 100 to an open configuration, positioning one or more plate within an interior area of encasement, moving the encasement to a closed configuration, and securing the encasement in the closed configuration, such as with a plurality of fasteners 130. In some embodiments, the method includes configuring each of a plurality of systems in a similar manner, thereby providing similar protection for each. In some embodiments, the method includes configuring at least some of a plurality of systems in a first manner and a second portion of a plurality of systems in a second manner, thereby providing different protection for each, such as to accommodate different risks and/or to address other issues, including but not limited to weight limitations, supply limitations, or the like. In some embodiments, the method further includes positioning a plurality of users based on system configurations and anticipated risks.

In some embodiments, the system includes positioning a plurality of users in close proximity to each other. In some embodiments, the method includes positioning users based on respective system configurations, such plates associated with respective systems and/or angles associated with respective plates. In some embodiments, the invention includes positioning adjacent personnel so as to further reduce risk of injury associated with ricocheting bullets.

Figure 18:
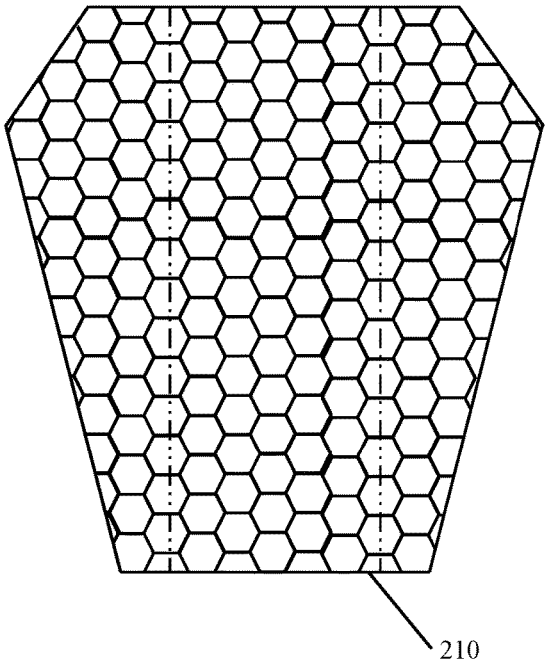
FIG. 18 is a front view of an embodiment of a plate of the present invention, the plate defining a honeycomb structure.

Referring to FIG. 18, some embodiments of the present invention include one or more plate having at least a first portion defining a honeycomb structure, such as those structures now known or later developed. In some such embodiments, the honeycomb structure comprises a plurality of inter-connected ribs and a plurality of voids defined thereby. In some embodiments, at least some of the plurality of ribs are formed from a first material and at least some of the voids are filled, at least partially, with one or more other material, thereby defining a plurality of discrete pockets of such material. In some embodiments, at least some of the plurality of ribs are configured to provide rigid support for maintaining relative positioning of each pocket of material relative to one or more other pocket of material.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

It will be appreciated that, in other embodiments, one or more of the first 210, second 220, and third 230 interior plates is removed to meet certain cost, weight, protection and/or other requirements and/or to accommodate one or more size, weight, material availability, budget, or other limitations. It will further be appreciated that, in some embodiments, one or more fourth, fifth, or other plate is added to the system, as a replacement for and/or in addition to one or more of the first, second, or third plates, or the like. It will still further be appreciated that one or more plate may be formed from a different material, now known or later developed, such to provide protection against one or more risk now known or later realized. It will still further be appreciated that one or more of the plates may be secured to each other and/or to the encasement.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall within the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A body armor system comprising:

an outer encasement comprising a front shell and a rear shell, the outer encasement defining an interior area when the outer encasement is in a closed configuration; and a first plate positioned within said interior area of said outer encasement, wherein said front shell comprises a front plate and a flange extending thereform, wherein said rear shell comprises a rear plate and a flange extending therefrom, and wherein said flange of said front shell is coupled to said flange of said rear shell when said encasement is in the closed configuration, thereby forming at least part of an external barrier surrounding edges of the first plate.

2. The body armor system of claim 1, wherein said outer encasement is moveable to an open configuration so as to facilitate removal of said first plate from said interior area of said outer encasement, thereby facilitating inspection of said first plate.

3. The body armor system of claim 1, wherein said outer encasement is moveable to an open configuration so as to facilitate positioning a second plate within said interior area of said outer encasement, thereby moving the body armor system from a first armor configuration to a second armor configuration, the first armor configuration being optimized to address a first threat and the second armor configuration being optimized to address a second threat.

4. The body armor system of claim 1, wherein said front shell is formed from a stainless steel material.

5. The body armor system of claim 4, wherein said first plate is a stopping plate.

6. The body armor system of claim 5, further comprising a second plate positioned between said front plate and said first plate, said second plate being a buffer plate.

7. The body armor system of claim 5, further comprising a third plate coupled to said first plate, said third plate being a maintenance plate.

8. The body armor system of claim 7, wherein said third plate is positioned between said first plate and said rear plate.

9. The body armor system of claim 8, wherein said third plate is a buffer plate.

10. The body armor system of claim 9, wherein said front plate comprises a front portion extending between opposed side portions, each of said side portions being angled backwards from said front portion such that the front plate is symmetrical about a vertical centerline of said front portion.

11. A method of configuring a body armor system to provide personal protection to a user, the method comprising:

positioning a first plate within an interior area of an outer encasement; and moving the outer encasement to a closed configuration, wherein the outer encasement comprises a front shell and a rear shell, wherein the front shell comprises a front plate and a flange extending therefrom, wherein the rear shell comprises a rear plate and a flange extending therefrom, and wherein the flange of the front shell is coupled to the flange of the rear shell when the encasement is in the closed configuration, thereby forming at least part of an external barrier surrounding edges of the first plate.

12. A method of using a body armor system to provide personal protection to a user, the method comprising configuring the body armor system by:

positioning a first plate within an interior area of an outer encasement; and moving the outer encasement to a closed configuration, wherein the outer encasement comprises a front shell and a rear shell, wherein the front shell comprises a front plate and a flange extending therefrom, wherein the rear shell comprises a rear plate and a flange extending therefrom, and wherein the flange of the front shell is coupled to the flange of the rear shell when the encasement is in the closed configuration, thereby forming at least part of an external barrier surrounding edges of the first plate, the method further comprising:

moving the outer encasement to an open configuration;

removing the first plate from the outer encasement;

inspecting the first plate for damage;

placing the first plate back into the outer encasement after confirming that the first plate is not damaged; and moving the outer encasement back to the closed configuration.

13. The method of claim 12, further comprising:

moving the outer encasement to an open configuration;

positioning a second plate within the interior area of the outer encasement; and moving the outer encasement back to the closed configuration.

14. The method of claim 13, wherein the front shell is formed from a stainless steel material.

15. The method of claim 14, wherein the first plate is a stopping plate.

16. The body armor system of claim 15, further comprising positioning a second plate between the front plate and the first plate, the second plate being a buffer plate.

17. The method of claim 16, further comprising coupling a third plate to the first plate, the third plate being a maintenance plate.

18. The method of claim 17, further comprising positioning the third plate between the first plate and the rear plate.

19. The method of claim 18, wherein the third plate is a buffer plate.

20. The method of claim 19, wherein the front plate comprises a front portion extending between opposed side portions, each of the side portions being angled backwards from the front portion such that the front plate is symmetrical about a vertical centerline of the front portion.

* * * * *